US005520256A

United States Patent [19]

Eddison

[11] Patent Number: 5,520,256

[45] Date of Patent: May 28, 1996

[54] ARTICULATED DIRECTIONAL DRILLING MOTOR ASSEMBLY

[75] Inventor: Alan M. Eddison, Houston, Tex.

[73] Assignee: Schlumberger Technology Corporation, Sugar Land, Tex.

[21] Appl. No.: 332,682

[22] Filed: Nov. 1, 1994

[51] Int. Cl.[6] ..... E21B 7/08

[52] U.S. Cl. ..... 175/61; 175/73; 175/76

[58] Field of Search ..... 175/61, 73, 76

[56] References Cited

U.S. PATENT DOCUMENTS

| | | | |
|---|---|---|---|
| Re. 33,751 | 11/1991 | Geczy et al. | 175/61 |
| 2,319,236 | 5/1943 | Isaacks et al. . | |
| 2,687,282 | 8/1954 | Sanders . | |
| 2,694,549 | 11/1954 | James . | |
| 2,876,992 | 3/1959 | Lindsay . | |
| 3,068,946 | 12/1962 | Frisby et al. | 175/73 |
| 3,098,534 | 7/1963 | Carr et al. | 175/73 |
| 3,370,657 | 2/1968 | Antle | 175/74 |
| 3,457,999 | 7/1969 | Massey | 175/61 |
| 3,561,549 | 2/1971 | Garrison et al. | 175/76 |
| 3,637,032 | 1/1972 | Jeter | 175/73 |
| 3,667,556 | 6/1972 | Henderson | 175/73 |
| 3,878,903 | 4/1975 | Cherrington | 175/45 |
| 3,903,974 | 9/1975 | Cullen | 175/17 |
| 4,040,495 | 8/1977 | Kellner et al. | 175/73 |
| 4,185,704 | 1/1980 | Nixon, Jr. | 175/76 |
| 4,220,213 | 9/1980 | Hamilton | 175/45 |
| 4,291,773 | 9/1981 | Evans | 175/61 |
| 4,305,474 | 12/1981 | Farris et al. | 175/73 |
| 4,428,441 | 1/1984 | Dellinger | 175/61 |
| 4,449,595 | 5/1984 | Holbert | 175/79 |
| 4,456,080 | 6/1984 | Holbert | 175/61 |
| 4,461,359 | 7/1984 | Jones, Jr. et al. | 175/61 |
| 4,465,147 | 8/1984 | Feenstra et al. | 175/73 |
| 4,492,276 | 1/1985 | Kamp | 175/61 |
| 4,523,652 | 6/1985 | Schuh | 175/61 |
| 4,560,013 | 12/1985 | Beimgraben | 175/73 |
| 4,637,479 | 1/1987 | Leising | 175/26 |
| 4,662,458 | 5/1987 | Ho | 175/27 |
| 4,667,751 | 5/1987 | Geczy et al. | 175/61 |
| 4,699,224 | 10/1987 | Burton | 175/61 |
| 4,714,118 | 12/1987 | Baker et al. | 175/26 |
| 4,739,843 | 4/1988 | Burton | 175/73 |
| 4,807,708 | 2/1989 | Forrest et al. | 175/45 |
| 4,821,815 | 4/1989 | Baker et al. | 175/26 |
| 4,836,301 | 6/1989 | Van Dongen et al. | 175/61 |
| 4,858,705 | 8/1989 | Theiry | 175/73 |
| 4,867,255 | 9/1989 | Baker et al. | 175/61 |
| 4,880,067 | 11/1989 | Jelsma | 175/107 |
| 4,901,804 | 2/1990 | Thometz et al. | 175/40 |
| 4,938,298 | 7/1990 | Rehm | 175/61 |
| 4,995,465 | 2/1991 | Beck et al. | 175/27 |
| 5,050,692 | 9/1991 | Beimgraben | 175/61 |
| 5,113,953 | 5/1992 | Noble | 175/61 |
| 5,265,687 | 11/1993 | Gray | 175/61 |
| 5,311,952 | 5/1994 | Eddison et al. | 175/61 |
| 5,311,953 | 5/1994 | Walker | 175/61 |
| 5,316,093 | 5/1994 | Morin et al. | 175/74 |

FOREIGN PATENT DOCUMENTS 2246151 1/1992 United Kingdom .

OTHER PUBLICATIONS

Anadrill Schlumberger Brochure, "Anadrill Tightens Directional Control with Downhole–Adjustable Stabilizers", no date.

*Primary Examiner*—Hoang C. Dang

*Attorney, Agent, or Firm*—David L. Moseley; Wayne I. Kanak

[57] ABSTRACT

An articulated directional drilling tool assembly for use in drilling a borehole having a short radius of curvature includes a mud motor whose housing is pivotally connected to a lower housing having upper and lower sections that are joined together in a manner to define a bend angle. The lower housing section carries a full gage stabilizer that centers its lower end in the borehole. The upper housing section carries pads which are forced against the low side of the borehole by a hydraulic piston to increase the side loading on the bit below the lower housing section and cause it to drill a sharply curving borehole. The motor housing is connected to the lower housing by an articulative, torque transmitting coupling, and the motor housing is connected to an orientation measuring sub thereabove in the same manner.

18 Claims, 4 Drawing Sheets

ARTICULATED DIRECTIONAL DRILLING MOTOR ASSEMBLY

BACKGROUND OF THE INVENTION

1. Field of the Invention

This invention relates generally to a downhole drilling motor and bit assembly for use in rapidly changing the inclination of a borehole, and particularly to an articulated assembly that is adapted to drill a curved well bore section having a relatively short radius of curvature.

2. Description of the Related Art

When curved well bores are drilled with conventional techniques and equipment, a relatively long radius of curvature in the range of several hundred feet or more is required. Thus the overall length of the curved section is quite long and must be carefully monitored to ensure that the outer end of the section arrives at a specified location. Such equipment typically includes a mud motor having a bend angle built into its housing above the bit bearing section but below the power section of the motor. An undergage stabilizer usually is run above the bit to generally center it in the borehole while allowing it to drill a hole that curves gradually upward as the inclination angle builds up. The radius of curvature is controlled primarily by the bend angle being used, which typically can be in the range of from 1°–3°. However, even when a bend angle on the upper end of this range is employed, the radius of curvature still is rather long.

There are numerous circumstances where the drilling of a curved well bore section having a relatively short radius of curvature is advantageous. One example is where a vertical well bore is turned to the horizontal through vertical fractures in order to increase production. Also, the geology above the production zone may make it desirable to drill vertically through a certain rock layer and then curve the borehole sharply below it. Moreover, a relatively short radius of curvature allows the surface facilities to be closer to a position generally over the production zone than if a long radius curved section is drilled. It may also be desirable to drill several horizontal boreholes at different azimuths from a single vertical borehole to improve drainage. When a number of wells are drilled from an offshore platform, one or more wells having a horizontal section may be necessary to tap the production directly below the site of the platform. Other occasions where a horizontal well bore is needed will be apparent to those familiar with the art. In each case a short radius curve can be drilled in less time with reduced cost.

An object of the present invention is to provide a new and improved drilling motor assembly that is constructed and arranged to drill a curved borehole on a relatively short radius of curvature.

Another object of the present invention is to provide a new and improved articulated drilling motor assembly which allows the drilling of a curved borehole section having a short radius of curvature.

Still another object of the present invention is to provide a new and improved articulated drilling motor assembly which includes spaced stabilizer means having a bend angle therebetween to allow the inclination angle to build up at a high rate during drilling.

SUMMARY OF THE INVENTION

These and other objects are attained in accordance with the concepts of the present invention through the provision of an articulated directional drilling motor assembly including a power section that responds to the flow of drilling fluids to provide a rotary output that is coupled by a drive shaft and a bearing mandrel to a drill bit on the lower end of the assembly. A first articulative joint means connects the housing of the power section to a lower housing having a drill bit at its lower end. The lower housing includes an upper section and a lower section that are connected together in a manner that defines a bend angle. Wall-engaging pads and a hydraulic piston are mounted on respective opposite sides of the upper housing section, and a stabilizer is mounted on the lower housing section near the bit. An articulative joint that prevents relative rotation connects the motor housing and lower housing to one another. During drilling, fluid pressure in the housing extends the hydraulic piston, and reaction forces shift the opposed pads against the low side of the borehole. This tilts the upper end of the upper section toward the low side of the borehole, and, in effect increases the bend angle so that the assembly drills on a sharper curve. Another articulative joint connects the upper end of the motor housing to a wireline orientation sub or an MWD tool which allows the trajectory of the curved hole to be monitored at the surface.

BRIEF DESCRIPTION OF THE DRAWINGS

The present invention has the above as well as other objects, features, and advantages which will become more clearly apparent in connection with the following detailed description of a preferred embodiment, taken in conjunction with the appended drawings in which.

DESCRIPTION OF A PREFERRED EMBODIMENT

Figure 1:
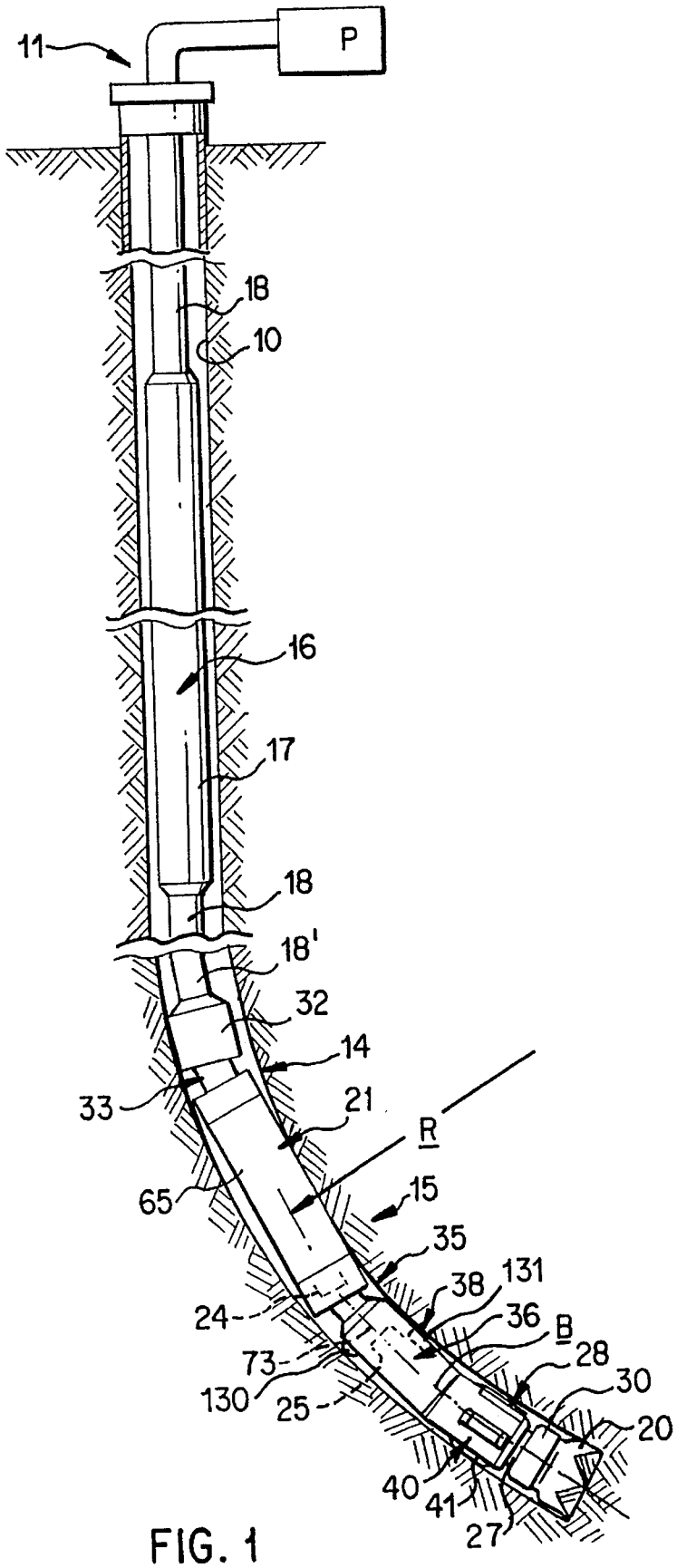
FIG. 1 is a schematic view of a well having a short radius directional section that is curving from the vertical toward the horizontal.

Referring initially to FIG. 1, a borehole 10 is shown extending downward, substantially vertically, from a surface site 11 where a drilling rig (not shown) is located. At some depth below the surface, depending on geology and other factors, the borehole 10 is shown being curved through a section 14 that eventually will bring its outer end to the horizontal. The radius of curvature R of the section 14 is relatively short, and through use of the present invention can be in the order of about 60 feet for an assembly that is used to drill a borehole having a diameter of 6⅛". The curved section 14 is drilled with an articulated drilling motor assembly 15 that is constructed in accordance with the present invention. The motor assembly 15 is run on a drill string 16 that typically includes a length of heavy drill collars 17 suspended below a length of drill pipe 18. A lower section of drill pipe 18' is used in the curved section 14 of the borehole 10, since the drill collars usually are too stiff to negotiate the curve and still function to apply weight. A drill bit 20 on the lower end of the motor assembly 15 can be either a rolling cone or a diamond device. The power section 21 of the motor assembly 15 preferably is the well-known Moineau-type design where a helical rotor rotates in a lobed stator in response to drilling mud being pumped through it under pressure. The lower end of the rotor is coupled by a universal-joint shown schematically at 24 to an intermediate drive shaft 73 whose lower end is coupled by another universal joint 25 to the upper end of a hollow mandrel 27. The mandrel 27 is journaled for rotation in a bearing assembly 28, and the drill bit 20 is attached to a bit box 30 on the lower end of the mandrel 27.

The upper end of the drilling motor assembly 15 can include a tubular orienting sub 32 that is connected to the upper end of the power section 21 by a ball joint assembly 33. The lower end of the housing 65 of the power section 21 is connected by another ball joint assembly 35 to the upper end of a lower housing 36. The housing 36 includes upper and lower sections that are connected together in a manner such that their longitudinal centerlines intersect within the connection to establish a bend angle at about bend point B. As will be explained in detail below, the upper section of the lower housing 36 carries a pair of angularly spaced, outwardly extending pads 130 whose outer faces engage the low side of the borehole 14 and provide an upper touch point. The upper section of the lower housing 36 also carries a hydraulically operable piston means 38 on the side thereof opposite the pads 130 that tends to extend under pressure and engage the high side of the borehole 14. Alternatively, piston means 38 may be spring actuated. A concentric stabilizer 40 is mounted in fixed position on the lower section of the housing 36 below the bend point B, and includes a plurality of angularly spaced, longitudinal ribs 41 whose outer faces lie in a cylinder having a longitudinal axis that is coincident as the axis of the mandrel 27 so as to tend to centralize the lower housing section in the borehole. The stabilizer 40 may be full gage, generally 1/16 inch or less smaller than borehole diameter, or it may be slightly undergage depending upon drilling conditions. The ribs 41 may be considered as providing a second touch point with the borehole 14. The operation of the pads 130, the piston means 38, the stabilizer 40 and the bend angle will be explained in detail below. Generally, however, these components together with the articulative joints 35 and 33 enable the bit 20 to drill on a relatively sharp curve by allowing rapid build-up of the inclination angle of the borehole 14 as drilling proceeds.

Figure 2A:
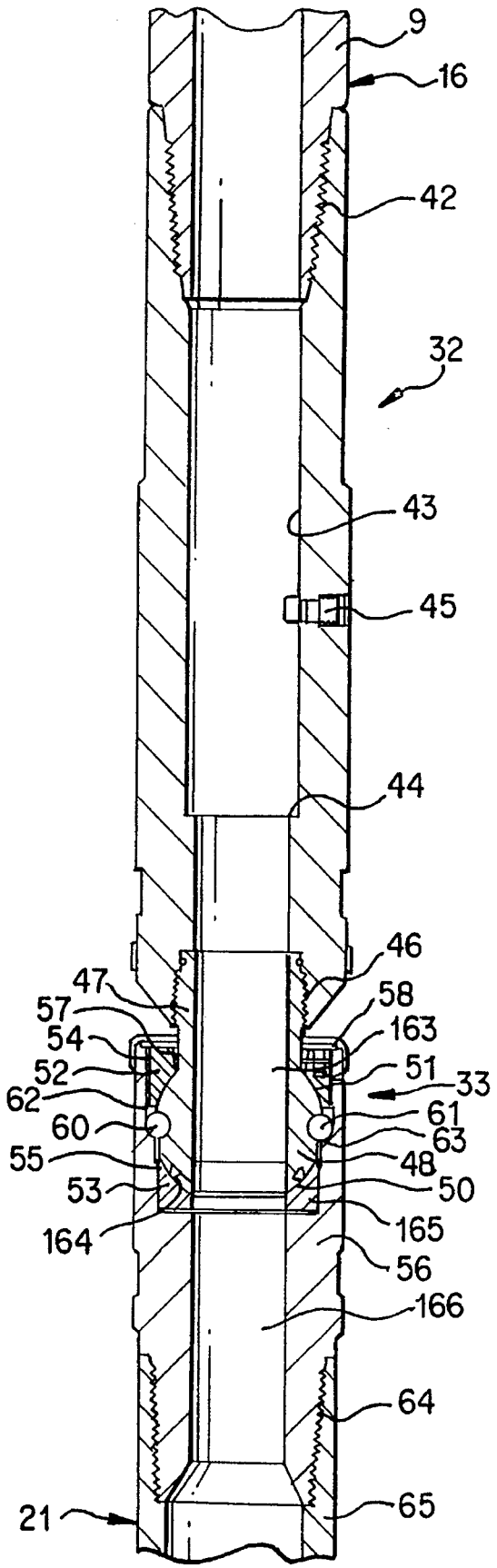
FIGS. 2A–2C are longitudinal cross-sectional views of the articulated drilling motor assembly of the present invention.

Turning now to FIG. 2A for a more detailed description of the present invention, the orienting sub 32 has threads 42 by which its upper end is connected to an adapted sub 9 which attaches to the lower end of the drill string 16. The sub 32 has an enlarged diameter bore 43 which extends down to a shoulder 44 so that a typical guide sleeve (not shown) can be inserted into the bore and held therein by a radial lock pin 45. An orienting mandrel (not shown) may be lowered through the drill string 16 on an electric wireline and seated in such sleeve so that directional parameters such as inclination, azimuth and toolface can be read out at the surface. These parameters can be used to properly orient the assembly 15 at the kick-off point where the curved borehole section 14 begins, and to monitor the progress of the hole as needed. In the alternative, the sub 32 can be used with a typical measuring-while-drilling (MWD) tool having sensors to measure the above-mentioned parameters and transmit mud pulse signals to the surface which are representative thereof. An MWD tool of this type is disclosed in U.S. Pat. Nos. 4,100,528, 4,103,281, 4,167,000 and 5,237,540, which are incorporated herein by reference.

The lower end of the sub 32 is threaded at 46 to the neck 47 of an articulative coupling in the form of a ball 48. The spherical outer surfaces 50, 51 of the ball 48 are engaged by companion surfaces on upper and lower ring members 52, 53 that seat in upper and lower internal annular recesses 54, 55 in the upper end of ball joint housing 56. The upper ring 52 has a conical upper surface 57 that when engaged by outer surfaces on the neck 47 limit off-axis pivotal movement of the ball 48 to a selected angle such as 5°. The upper ring member 52 can be threaded into the recess 54, and held by a retainer ring 58 that is fixed by one or more screws. A plurality of ball bearings 60, 61 which seat in semi-spherical recesses on the sides of the ball 48 engage in longitudinal slots 62, 63 in the housing 56 to co-rotatively couple the ball to the housing so that torque can be transmitted through the ball joint.

Figure 2B:
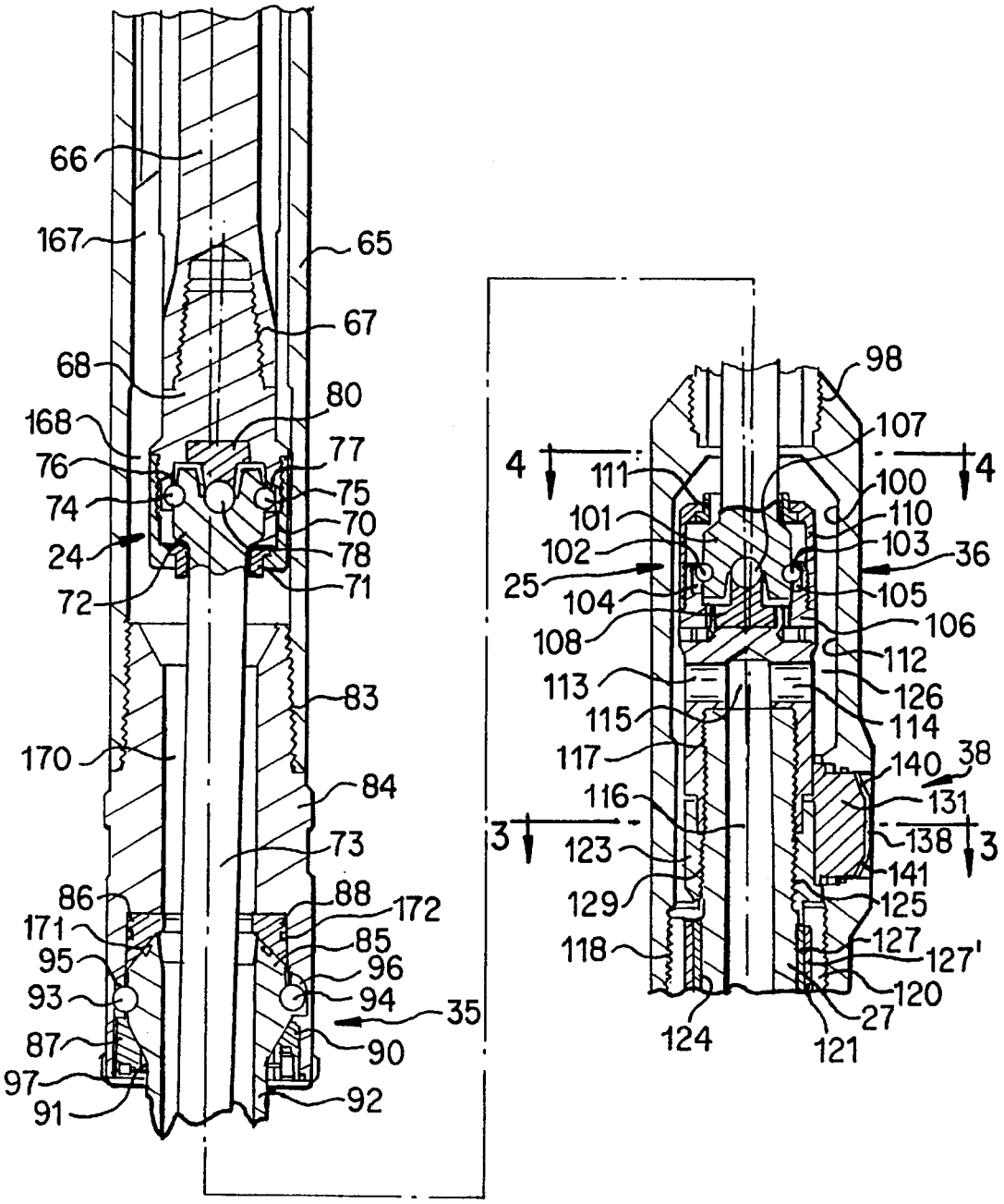

The lower end of the ball joint housing 56 is connected by threads 64 to the upper end of the housing 65 of the mud motor power section 21. The internal details of the power section 21 are well known and need not be set forth herein. As shown in FIG. 2B, the lower end portion 66 of the power section rotor is threaded at 67 to the driving member 68 of the upper universal joint 24. The member 68 has a depending skin 70 that carries a retaining ring 71, and the driven member 72 of the universal joint 24 is mounted on the upper end of an intermediate drive shaft 73 that extends down through the retaining ring. The driven member 72 carries a plurality of drive balls 74, 75 that are seated in semi-spherical recesses and engage in longitudinal slots 76, 77 inside the lower end of the driving member 68. The balls 74, 75 transmit torque from the rotor 66 to the drive shaft 73 while allowing wobbling motion of the lower end portion of the rotor to occur. If desired, an enlarged diameter ball bearing 78 which is received in opposed semi-spherical recesses in the member 72 and in an upper block 80 that fits in a recess in the driving member 68 can be employed to stabilize the universal joint during orbital motion.

The lower end of the power section housing 65 is threaded at 83 to a lower articulative ball joint housing 84. Hereagain a ball member 85 is fitted between upper and lower ring members 86, 87 which seat in upper and lower internal recesses 88, 90 in the lower portion of the housing 84. The lower ring member 87 has a conical inner surface 91 to limit off-axis pivotal rotation of the ball 85 and its neck 92 to about 5°. Balls 93, 94 which engage in longitudinal grooves 95, 96 co-rotatively secure the ball member 85 to the housing 84. A retainer ring 97 and a screw hold the ring members 86, 87 and the ball member 85 assembled. The neck 92 is connected by threads 98 to the upper end of the lower housing 36. The housing 36 has an internal recess 100 which houses the lower universal joint assembly 25 by which the lower end of the drive shaft 73 is connected to the upper end of the bearing mandrel 27. The driving member 101 of the universal joint assembly 25 has recesses which carry a plurality of drive balls 102, 103 that engage in longitudinal slots 104, 105 on the driven member 106. As in the previously described universal joint, an enlarged diameter ball bearing 107 that seats in a bearing block 108 stabilizes rotation. A skirt 110 on the driven member 106 carries a retaining ring 111 on its upper end.

Figure 2C:
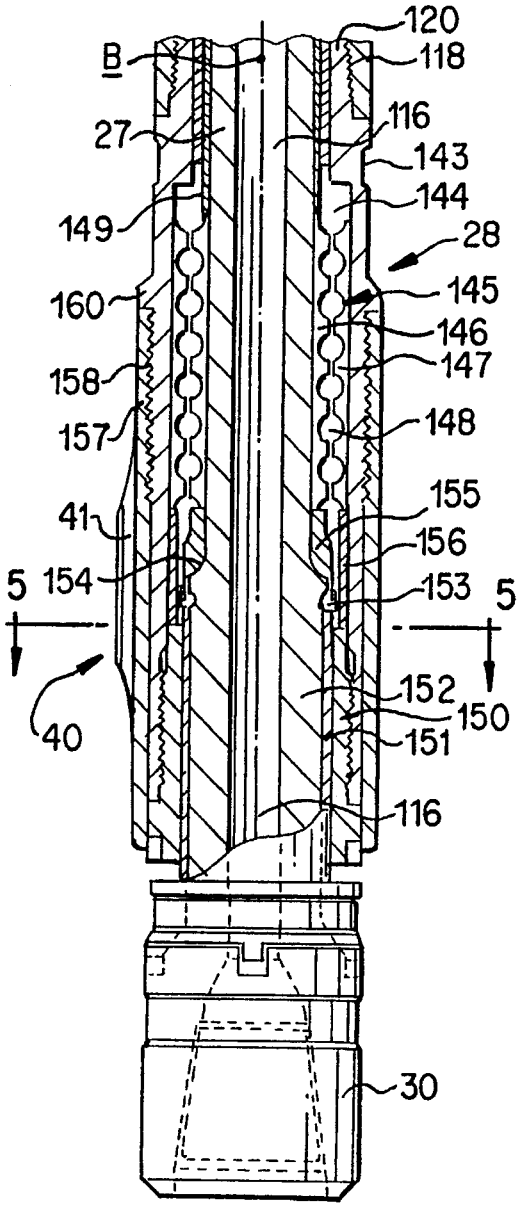

The outer peripheries of the skirt 110 and the driven member 106 are spaced inwardly of the inner walls 112 of the lower housing 36 to provide an annular fluid passageway 126 that leads to radial ports 113, 114 which communicate with a bore 115 so that mud flow can enter the central bore 116 of the bearing mandrel 27 and pass downward toward the bit 20. The upper end of the mandrel 27 is connected by threads 117 to the lower end of the driven member 106 and is thus rotated thereby. As shown in FIG. 2C, the housing 143 of the bearing assembly 28 surrounds a bearing 145, and the upper portion 120 thereof is threaded at 118 to the lower end of the housing 36. A seal sleeve 121 (FIG. 2B) is fixed inside the upper portion 120 of the housing 143. A bearing sleeve 124 whose upper end is engaged by a nut 123 that is threaded onto the bearing mandrel 27 at 129 extends through the seal sleeve 121 and is positioned between it and the upper portion of the bearing mandrel 27. A seal ring 127 prevents leakage between the sleeve 124 and the mandrel 27, and another seal ring 127' prevents leakage between the seal sleeve 121 and the housing 143.

Figure 3:
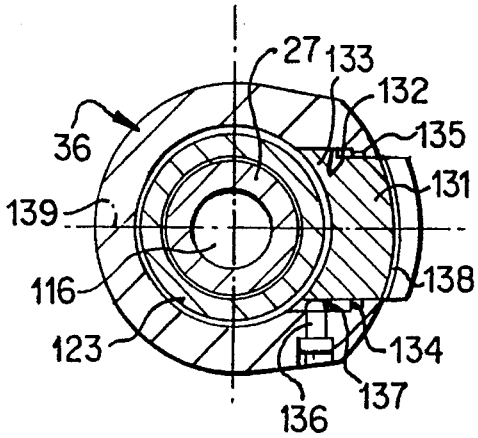
FIG. 3 is a somewhat enlarged cross-section taken on line 3—3 of FIG. 2B.
Figure 4:
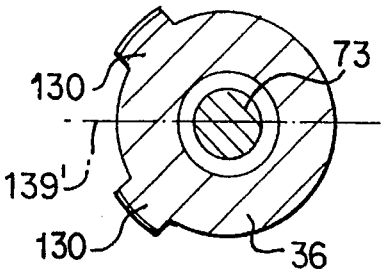
FIG. 4 is a cross-section on line 4—4 of FIG. 2B.

As shown in cross-section in FIG. 4, the upper section of the lower housing 36 has a pair of outwardly extending pads 130 on one side of its longitudinal axis. The pads 130 are angularly spaced at about 90° to one another, and the outer face of each pad is somewhat undergage. For example each outer face is arcuate and formed on a radius of about 2.75 inches for a borehole diameter of 6⅛". Thus when the pads touch the low side of the borehole wall, the upper end of the lower housing 36 is radially offset by about 5/16 inch toward such low side. Referring now to FIGS. 2B and 3, a hydraulically operable piston or button 131 is mounted in a radial bore 132 on the opposite side of the housing 36 from the pads 130. The piston 131 can move along a radial line 139 which is parallel to a line 139' (FIG. 4) which has the pads 130 at equal angles on opposite sides thereof. The piston 131 has an annular shoulder 133 on the rear thereof which cooperates with an inwardly facing stop shoulder 134 to limit outward movement under pressure. A seal ring 135 prevents fluid leakage past the piston 131. A guide pin 136 on the housing 36 whose inner end portion engages in a slot 137 in a side, of the piston 131 prevents the same from turning. The piston 131 has an arcuate outer face 138 on its central portion and inwardly inclined upper and lower faces 140, 141 (FIG. 2B) which keep the piston from hanging up on the well bore wall. The outer faces of the piston 131 and the pads 130 may incorporate hardfacing material to minimize wear. When the piston 131 is retracted as shown in FIGS. 2B and 3, the outer surfaces of the enlarged region of the housing 36 adjacent thereto, and the outer surfaces of the pads 130 are generally symmetrical about the longitudinal axis of the mandrel 27. However, when the piston 131 is extended as shown in phantom lines in FIG. 3 in response to drilling fluid pressure acting on the inner wall thereof, the upper end of the housing 36 is forced toward the opposite wall of the borehole 10 until the pads 130 engage such wall. When the piston 131 is retracted as shown, the motor assembly 15 can be run into a straight borehole 10 having the same diameter as the curved section 14 to be drilled.

As shown in FIG. 2C, the housing 143 and the bearing mandrel 27 define an internal annular chamber 144 in which a bearing 145 is mounted. The bearing 145 includes a plurality of inner and outer race rings 146, 147 which carry a plurality of ball bearings 148. A collar 150 which is threaded into the lower end portion of the housing 143 surrounds a radial bearing sleeve 151 that fits over the enlarged diameter lower end portion 152 of the mandrel 27. The upper end of the bearing sleeve 151 engages a stop ring assembly 153. The inwardly inclined upper shoulder 154 of the mandrel 27 engages a transfer ring 155 which in turn engages the lower end of the inner race ring 146. A spacer sleeve 156 engages between the upper end of the collar 150 and the lower end of the outer race ring 147. The upper end of the inner race ring 146 engages a short collar 149 which is up against the bearing sleeve 124. Thus arranged, the bearing assembly 28 carries both thrust and radial loads which can be quite high during directional drilling operations.

Figure 5:
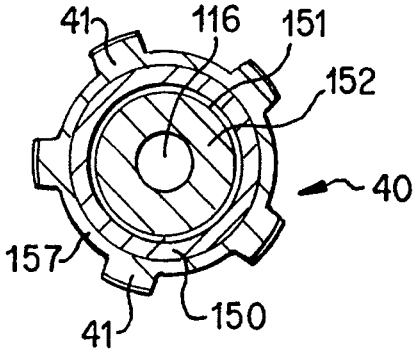
FIG. 5 is a cross section on line 5—5 of FIG. 2C.

A lower stabilizer indicated generally at 40 is carried on the housing 143 immediately above the bit box 30. As shown in FIGS. 2C and 5, the stabilizer 40 includes an elongated sleeve member 157 having internal threads 158 at its upper end portion which engage external threads below an enlarged diameter shoulder 160 on the housing 143 in order to fix the same thereto. The sleeve member 157 has a plurality, for example, five, angularly spaced, outwardly extending longitudinal ribs 41 with each rib having an arcuate outer face that can be covered with a hard facing material to reduce wear. A cylinder that contains the outer faces of the ribs 41 preferably is concentric with respect to the longitudinal axis of the sleeve 157 so that the ribs provide touch points around both the high and low sides of the hole tending to center the lower end of the mandrel 27 therein. The diameter of such cylinder is generally equal to, or only slightly smaller than, the gage diameter of the bit 20.

The threaded connection 118 between the lower housing 36 and the housing 143 is constructed so that the centerlines of these members are not coaxial, but intersect one another at about point B in FIG. 2C. This construction establishes a small bend angle between the housings 36 and 143 that preferably has a value between 1°–3° so that the axis of rotation of the bit 20 is tilted to the right, as viewed in the drawing FIG. 2C, in the plane of the drawing sheet. Such plane also contains the radial centerline 139 of the piston 131 and the radial line 139' in FIG. 4, and also defines the toolface angle of the bit 20 with respect to a reference such as the low side of the borehole section 14. In this instance the toolface angle is 0°, which means that the bit 20 will build up the inclination angle without drilling to the right or the left of the previously drilled hole, as viewed from above.

Drilling mud flows down through the motor assembly 15 as follows. Drilling fluid or mud under pressure is pumped down the drill string 16 where it flows through the orienting sub 32 and the ball joint 48, respectively. Seal rings 164, 165 on the ball 48 and the lower ring member 53 prevent leakage to the outside. Then the mud flows through the bore 166 of the ball joint housing 56 and into the upper end of the mud motor power section housing 65 where it causes the rotor 66 to turn within the stator and thus drive the shaft 73, the bearing mandrel 27 and the drill bit 20. The mud flow emerges from the lower end of the power section of the motor 21 through the annular passageway 167 (FIG. 2B) around the lower end portion of the rotor 66, and passes via additional annular passageways 168, 170 which surround the upper universal joint 24 and the intermediate drive shaft 73 as it passes through the lower ball joint 35. The lower ball joint 35 also includes seal rings 171, 172 which prevent leakage to the outside. As noted above, the mud flow then goes down through the annular passageway 126 around the lower universal joint 25, inwardly via the radial ports 113, 114, and into the bore 116 of the bearing mandrel 27. Eventually the mud flows through jets or orifices in the drill bit 20 and into the bottom of the borehole 10 where it circulates back up to the surface through the annulus. The presence of the bit jets or nozzles creates a back pressure so that during drilling the pressures inside the motor assembly 15 are somewhat greater than the pressure of drilling fluids in the well bore outside the assembly. The pressure difference acts across the hydraulic piston 131 to force it outward in its bore 132.

The chamber 144 in which the bearing 145 is located can be filled with a suitable lubricating oil, or mud lubrication can be employed as shown (no seal between the sleeves 121 and 124, or between collar 150 and sleeve 151). The positive internal pressure keeps debris-laden mud around the bit 20 from coming into the chamber 144 at its lower end.

OPERATION

In operation, the articulated directional drilling tool 15 is assembled as shown in the drawings and then is lowered into the well bore 10 on the drill string 16. When the bit 20 tags bottom, an orienting tool (not shown) can be run on electric wireline and seated in the orienting sub 32 where it is automatically oriented with respect to the tool assembly 15. Alternatively, a measuring-while-drilling (MWD) tool can be seated in the orienting sub 32 to make directional measurements and transmit mud pulse signals representative thereof to the surface. In either case the tool assembly 15 is turned slowly by the drill string 16 until the tool face angle of the bit 20 has the desired value. The motor power section 21, which is a positive displacement device, turns in response to mud circulation and rotates the drive shaft 73, the bearing mandrel 27, the bit box 30 and the bit 20. Drill string weight is imposed on the tool assembly 15 to commence drilling the hole section 14.

The stabilizer 40 on the housing 143 engages the borehole walls to provide a fulcrum, and pressure forces on the piston 131 cause it to move radially outward and engage the high side of the hole. The reaction force pushes the upper end of the housing 36 over toward the low side of the borehole until the outer faces of the pads 130 engage the walls thereof. Such reaction force employs the fulcrum of the stabilizer 40 to generate lateral deflection force on the bit 20 which causes it to drill a rather sharp curve. The ball joints 48, 85 allow angle build-up to occur much more severely than would be the case if these joints were not present. The outer ball bearings 60, 61, 93, 94 of each joint prevent relative rotation of the housings so that reactive torque due to operation of the bit 20 is transmitted to the drill string 16. In case a wireline orientation tool is used, the drilling can be periodically stopped, and a survey made by lowering and seating the tool in the sub 32. Where an MWD tool is used to measure directional parameters and toolface, such measurements can be made continuously as drilling proceeds.

Several features of the present invention act in concert to cause the curved section 14 of the borehole 10 to be drilled at a relatively short radius of curvature R. The presence of bend point B between the stabilizer 40 and the pads 130 causes the bit 20 to build up or increase the inclination angle at a high rate. The fact that the pads 130 are undergage allows use of the stabilizer 40 as a fulcrum which increases angle build-up. Additionally, the piston 131 moves out under pressure and tends to force the pads 130 against the opposite side wall. The fact that there is a ball joint 85 between the lower end of the motor housing 65 and the upper end of the lower housing 36 also enhances the curve drilling capability of the present invention by preventing the length and stiffness of the motor housing 65 from impeding the development of the curve. Once a borehole curvature has been obtained, the weight of the drill string 16 tends to force the pads 130 against the low side of the borehole section 14, and the piston 131 may not actually touch the high side of the borehole as drilling proceeds. Thus the section 14 of the borehole 10 can be drilled with a relatively short radius R of curvature compared to prior rigid directional drilling tool strings.

The present invention also can be used to drill a lateral borehole section that is substantially straight. For this purpose the assembly would be modified by replacing the upper pads 130 with pads which are slightly over-gage to nullify the effect of the bend angle. In this configuration the bit 20 will drill substantially straight ahead in response to operation of the mud motor 21.

If wireline or MWD measurements indicate that the "toolface" angle needs correction, this can be done, for example, by applying torque to the drill string 16 at the surface during additional drilling to gradually curve the lower end portion of the section 14 of the borehole 10 back to where the toolface angle has the desired value.

It now will be recognized that a new and improved articulated drilling motor assembly has been provided which allows relatively short radius curved boreholes to be drilled. Since certain changes or modifications may be made in the disclosed embodiment without departing from the inventive concepts involved, it is the aim of the appended claims to cover all such changes and modifications falling within the true spirit and scope of the present invention.

What is claimed is:

1. A directional drilling assembly for causing a drill bit to drill a curved borehole having a relatively short radius of curvature, said curved borehole having a high side and a low side, comprising: mud motor means for rotating a drive shaft which is coupled to said drill bit, said motor means having an upper housing and a lower housing, said lower housing containing bearing means for supporting a portion of said drive shaft; said lower housing including upper and lower sections connected together to form a bend angle; upper stabilizer means on said upper housing section; lower stabilizer means on said lower housing section; and articulative joint means connecting said lower housing to said upper housing to allow relative pivotal movement therebetween as said curved borehole is drilled.

2. The assembly of claim 1 wherein said upper stabilizer means includes outwardly extending means adapted to engage the low side of the borehole and normally retracted means adapted to be extended into engagement with the high side of the borehole during drilling to force said outwardly extending means against said low side, and wherein said lower stabilizer means is full gage.

3. The assembly of claim 2 wherein said normally retracted means includes piston means mounted for radial movement on said upper housing section, said piston means having a rear face subject to the pressure of fluids used to operate said motor means.

4. The assembly of claim 2 wherein said lower stabilizer means includes a plurality of angularly distributed longitudinal ribs adapted to engage the walls of the borehole adjacent said drill bit.

5. The assembly of claim 1 wherein said articulative joint means includes ball means on one of said housings engaged in socket means on the other of said housings; means for preventing relative rotation between said ball and socket means, and means for limiting said pivotal movement.

6. The assembly of claim 1 further including means coupled to the upper end of said upper housing for enabling the rotational orientation of said assembly in the borehole to be measured and telemetered to the surface.

7. The assembly of claim 6 further including second articulative joint means between said upper housing and said enabling means for permitting relative pivotal movement; and second means for preventing relative rotation between said upper housing and said enabling means.

8. An articulated directional drilling assembly for use in drilling a curved borehole having a high side and a low side and a relatively short radius of curvature, comprising: positive displacement motor means responsive to flow of drilling fluids for producing a rotary output, said motor means including upper and lower housings, said lower housing having upper and lower sections connected together to define a bend angle between the respective longitudinal axes thereof; drive means for coupling said rotary output to a drill bit on said lower housing section; first stabilizer means on said upper housing section including first wall-engaging means adapted to engage said low side of said borehole, said first wall-engaging means having a lesser radius than the radius of said borehole; second stabilizer means on said lower housing section including second wall-engaging means adapted to engage said low side and said high side of said borehole, said second wall-engaging means having substantially the same radius as the radius of said borehole; and articulative coupling means for connecting said upper and lower housings to one another in a manner to allow limited pivotal movement.

9. The assembly of claim 8 wherein said first stabilizer means further includes normally retracted, radially extendable piston means, said piston means being arranged when extended to engage said high side of said borehole and force said upper housing section and said first and second wall-engaging means toward said low side of said borehole.

10. The assembly of claim 9 further including means subjecting said piston means to the pressure of drilling fluids flowing through said motor means.

11. The assembly of claim 9 further including means in said articulative coupling means for preventing relative rotation between said upper and lower housing members.

12. The assembly of claim 11 further including means connected to said upper housing for measuring and telemetering to the surface the rotational orientation of said assembly in said borehole with respect to a reference.

13. The assembly of claim 12 further including another articulative coupling means for connecting said measuring and telemetering means to said upper housing, said another articulative coupling means including means for preventing relative rotation between said measuring and telemetry means and said upper housing.

14. A method of drilling a curved borehole having a relatively short radius of curvature, said borehole having a low side and a high side, comprising the steps of: providing a tubular housing assembly having an upper section and a lower section that are connected rigidly together in a manner such that their longitudinal centerlines intersect to form a bend angle; mounting a drill bit on said lower housing section and rotating said drill bit in response to flow of drilling fluids through said housing assembly; using stabilizer means including a stabilizer on said upper housing section to cause said drill bit to drill said curved borehole; forcing said stabilizer against said low side of said borehole by applying the pressure of said drilling fluid to a radially movable piston on said upper housing section; and shifting said piston into engagement with said high side of said borehole to produce reaction forces which force said stabilizer against said low side of said borehole.

15. The method of claim 14 including the further step of providing said stabilizer with wall-engaging means adapted to engage said low side of said borehole, said wall-engaging means having outer faces on a lesser radial dimension than the radius of said borehole.

16. The method of claim 15 including the further step of driving said bit with the power section of a mud motor, and connecting said mud motor to said upper housing section with an articulative joint that allows angular displacement while preventing relative rotation.

17. The method of claim 16 including the further steps of providing a means for measuring and telemetering to the surface the rotational orientation of said assembly in the borehole with respect to a reference, and connecting said measuring and telemetering means to said power section with an articulative joint that allows angular displacement while preventing relative rotation.

18. The method of claim 15 including the further step of arranging said stabilizer and said piston in a symmetrical manner about a longitudinal plane through the centerline of said upper housing section.

* * * * *